US008240110B2

(12) United States Patent
Griffiths

(10) Patent No.: US 8,240,110 B2
(45) Date of Patent: Aug. 14, 2012

(54) FIRE-RESISTANT GLASS BLOCK HAVING A THERMAL BREAK AND METHODS FOR MAKING SAME

(76) Inventor: Jeffry Griffiths, San Leandro, CA (US)

( * ) Notice: Subject to any disclaimer, the term of this patent is extended or adjusted under 35 U.S.C. 154(b) by 129 days.

(21) Appl. No.: 12/720,520

(22) Filed: Mar. 9, 2010

(65) Prior Publication Data

US 2010/0229483 A1 Sep. 16, 2010

Related U.S. Application Data

(60) Provisional application No. 61/160,205, filed on Mar. 13, 2009.

(51) Int. Cl.
*E04C 2/00* (2006.01)
*E04C 1/42* (2006.01)
*E04C 2/54* (2006.01)

(52) U.S. Cl. ..... 52/787.11; 52/307; 52/308; 52/306; 52/232

(58) Field of Classification Search ..... 52/306, 52/232, 787.11, 308, 307; 65/42
See application file for complete search history.

(56) References Cited

U.S. PATENT DOCUMENTS 4,986,048 A * 1/1991 McMarlin ..... 52/306
5,009,048 A * 4/1991 Paul ..... 52/308
5,595,032 A * 1/1997 Richards et al. ..... 52/306
5,928,724 A * 7/1999 Descamps et al. ..... 427/230
5,992,111 A * 11/1999 Waterhouse ..... 52/308
6,393,786 B1 * 5/2002 Hudson et al. ..... 52/306
6,553,733 B1 * 4/2003 Hock et al. ..... 52/306
7,266,930 B1 * 9/2007 Fisher ..... 52/306
2008/0172966 A1 * 7/2008 Voegele et al. ..... 52/308
2008/0209830 A1 * 9/2008 Voegele et al. ..... 52/308
2009/0173026 A1 * 7/2009 Voegele et al. ..... 52/308
2010/0139191 A1 * 6/2010 Atherton ..... 52/306

* cited by examiner

*Primary Examiner* — Mark Wendell
(74) *Attorney, Agent, or Firm* — Fliesler Meyer LLP

(57) ABSTRACT

A fire-resistant glass block including a thermal break and methods for making same. Embodiments of the glass block assembly include at least two portions filled with fire-resistant gel, wherein the at least two portions are connected using a thermal break channel. The thermal break channel improves the thermal conductions characteristics of the assembly and mitigates the potential for breakage in either glass block half unit through direct heat transfer. The glass block assembly can be made by connecting two or more glass portions using a thermal break channel and filling the connected glass block portions with fire-resistant gel.

20 Claims, 5 Drawing Sheets

FIRE-RESISTANT GLASS BLOCK HAVING A THERMAL BREAK AND METHODS FOR MAKING SAME

CLAIM OF PRIORITY

This application claims benefit to the following U.S. Provisional Patent Application:

U.S. Provisional Patent Application No. 61/160,205, entitled "Fire-Resistant Glass Block Having a Thermal Break and Methods for Making Same," by Jeffry Griffiths, filed Mar. 13, 2009.

FIELD OF THE INVENTION

The subject matter described herein relates to building materials and more specifically to a fire-resistant glass block having a thermal break for use in walls and/or windows and methods for making same.

BACKGROUND

Glass blocks and panels have become a popular alternative to conventional masonry bricks, plaster, wood and other materials in the construction of both residential and commercial buildings. The popularity of glass blocks can be attributed to, among other things, the aesthetic attractiveness of walls and/or windows made from glass blocks and the ability of the glass blocks to transmit light, thereby creating a naturally brighter indoor environment.

An important aspect of glass block construction is to ensure that the glass blocks used are not only aesthetically pleasing, but also safe when used. Consequently, an important feature of a glass block is its inherent ability to avoid product failure when exposed to a significant rise in temperature due to fire. Fire-rated glass blocks currently exist, but the existing glass blocks only have fire ratings up to 90 minutes and do not offer prolonged resistance to radiant heat transfer or limit surface temperature rise on the non-exposed block face.

BRIEF DESCRIPTION OF THE DRAWINGS

The accompanying drawings, which are incorporated into and constitute a part of this specification, illustrate one or more embodiments and, together with the detailed description, serve to explain the principles and implementations of the invention. In the drawings.

DETAILED DESCRIPTION

Embodiments are described herein in the context of a fire-resistant glass block having a thermal break for interior walls, exterior walls and/or windows and methods for making same. Those of ordinary skill in the art will realize that the following detailed description is illustrative only and is not intended to be in any way limiting. Other embodiments of the present invention will readily suggest themselves to such skilled persons having the benefit of this disclosure. Reference will now be made in detail to implementations of embodiments of the present invention as illustrated in the accompanying drawings. The same reference indicators will be used throughout the drawings and the following detailed description to refer to the same or like parts.

The present invention relates to fire-resistant glass blocks that can be used in interior walls, exterior walls and/or windows and methods of making the same. Embodiments of glass block assemblies of the present invention include two or more glass portions that are connected using a thermal break channel. When connected, the glass block portions define an inner cavity. The inner cavity can be filled with a fire-resistant gel to mitigate the transfer of radiant energy through the assembly, allowing the masonry unit to endure temperatures in excess of 1640° F. for the intended amount of time. Each assembled glass block of the present invention can be optically clear and can possess a fire rating of up to two hours when tested in accordance with current National Fire Protection Association ("NFPA") building component test standards.

Figure 1:
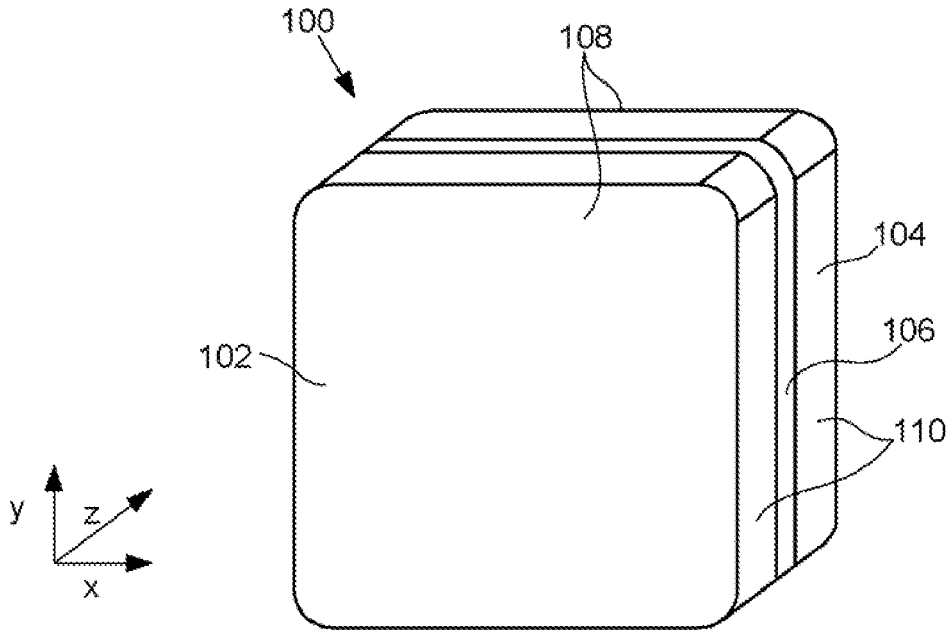
FIG. 1 illustrates a perspective view of a glass block assembly in accordance with an embodiment of the invention.
Figure 2:
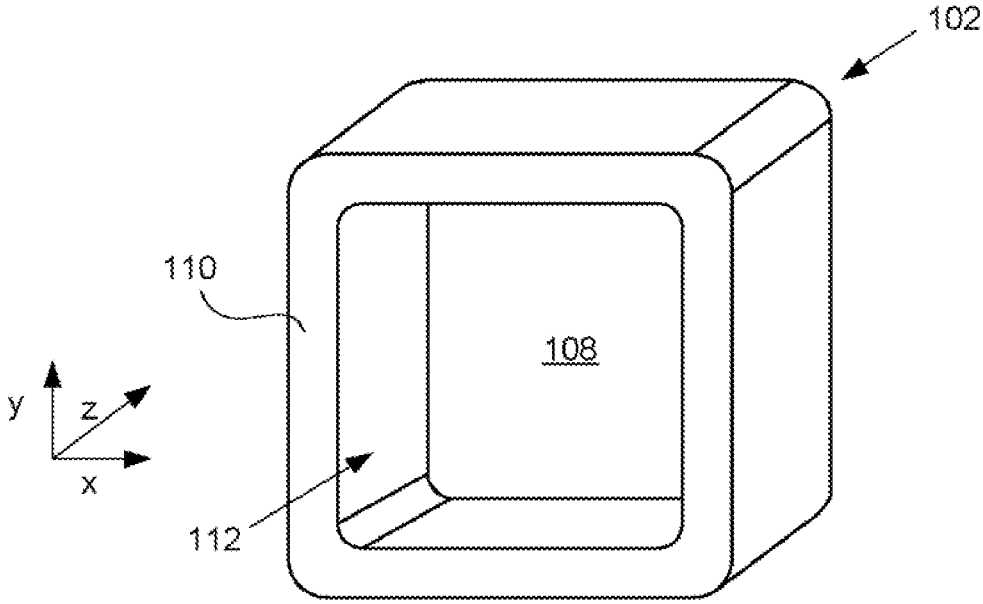
FIG. 2 illustrates a perspective view of a portion of glass block assembly in accordance with an embodiment of the invention.

FIG. 1 illustrates a glass block assembly in accordance with an embodiment of the invention. As shown in FIG. 1, glass block assembly, generally numbered 100, includes a first portion 102 and a second portion 104 connected by a thermal break channel 106. In this embodiment, both portions 102, 104 include an outer panel 108 and side walls 110 extending away from the outer panel 108. FIG. 2 illustrates portion 102 of glass block assembly 100 in greater detail. As shown in FIG. 2, the side walls 110 extend away from the outer panel 108 along the periphery of the outer panel 108, thereby forming a cavity 112 within glass block assembly 100.

Figure 3:
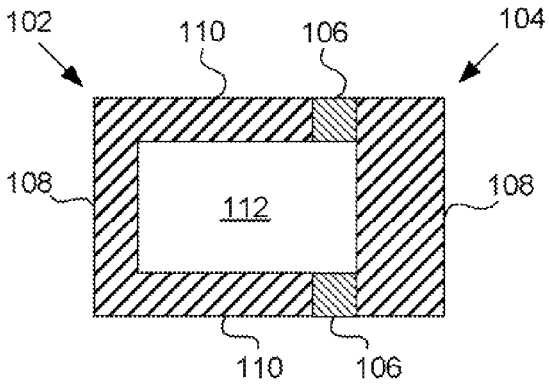
FIG. 3 illustrates a cross section of a glass block assembly in accordance with an embodiment of the invention.
Figure 4:
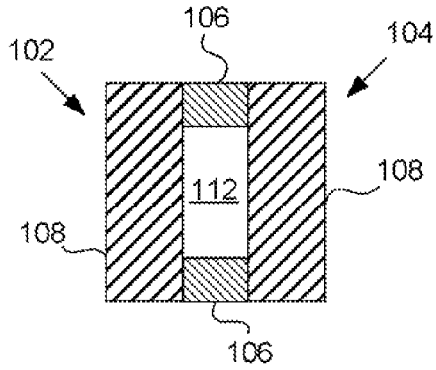
FIG. 4 illustrates a cross section of a glass block assembly in accordance with an embodiment of the invention.
Figure 5:
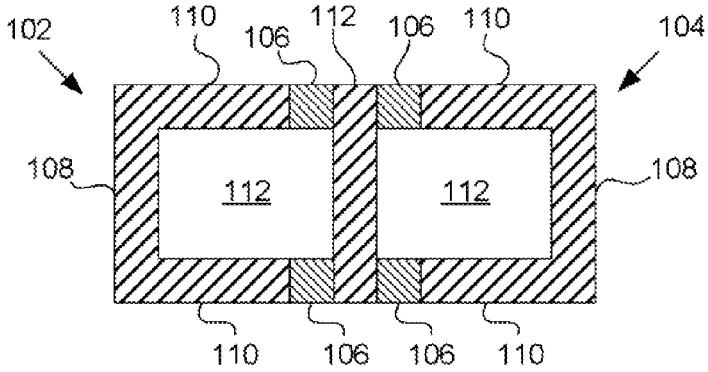
FIG. 5 illustrates a cross section of a glass block assembly in accordance with an embodiment of the invention.
Figure 6:
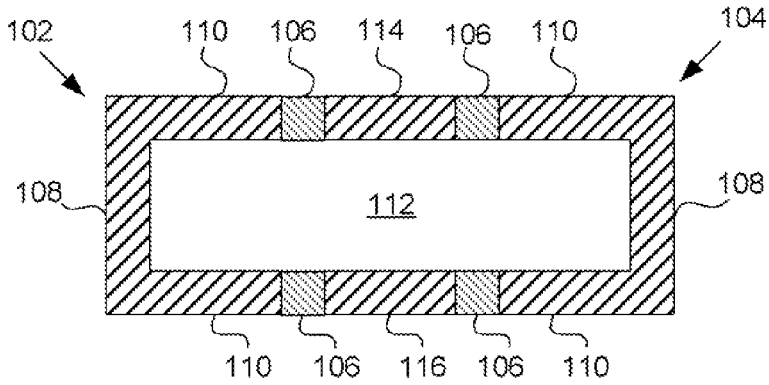
FIG. 6 illustrates a cross section of a glass block assembly in accordance with an embodiment of the invention.

FIG. 3 illustrates a cross-sectional view of an alternative embodiment of glass block assembly 100 where portion 102 includes sides walls 110 while portion 104 does not include any side walls. FIG. 4 illustrates a cross-sectional view of yet another alternative embodiment of glass block assembly 100 where both portions 102 and 104 do not include any side walls. In certain embodiments, glass block assembly may include more than two portions. For example, FIG. 5 illustrates a cross-sectional view of an embodiment of glass block assembly 100 including portions 102, 104 and a third central portion 112. FIG. 6 illustrates a cross-sectional view of yet another alternative embodiment that includes portions 102, 104 and two intermediate portions 114, 116.

It is to be understood that glass block assembly 100 can have any standard (or even non-standard) pattern, size, shape or color. The desired characteristics and dimensions of glass block assembly 100 can be varied depending on the project loads and in-service conditions for a particular project. The desired characteristics and dimensions of glass block assembly 100 can also be varied to accommodate American Society for Testing and Materials ("ASTM"), NFPA, Underwrites Laboratories, Inc. ("UL"), Uniform Building Codes ("UBC"), Consumer Product Safety Commission ("CPSC"), and/or Glass Association of North America ("GANA") requirements and/or standards.

Referring back to FIG. 1, as set forth above, glass block assembly 100 includes thermal break channel 106 that connects portion 102 to portion 104. It is to be understood that thermal break channel 106 not only connects portions 102, 104 together, but also serves a thermal break in between the portions 102, 104. In other words, thermal break channel 106 serves as an element of low thermal conductivity that can be placed in glass block assembly 100 to reduce the flow of thermal energy between the two conductive materials (i.e. portions 102, 104). Thermal break channel 106 thereby substantially prevents the transfer of heat through the glass block. Moreover, by separating portions 102, 104 of glass block assembly 100, the potential for breakage in either portion as a result of the direct heat transfer from the other portion (e.g., during a fire) is mitigated. In an embodiment, thermal break channel 106 is made of a material that has a thermal conductivity value below that of portions 102, 104. In certain embodiments, thermal break channel 106 can be made of any gel or polymer compatible material including, but not limited to, acrylic, ceramic, plastic, polycarbonates, polyurethanes, synthetic rubbers, fiberglass and masonite. In a further embodiment, a secondary seal can be used around the perimeter of the thermal break channel 106. Examples of the secondary seal include, but are not limited to, poly-sulfide rubber and silicone.

Figure 7:
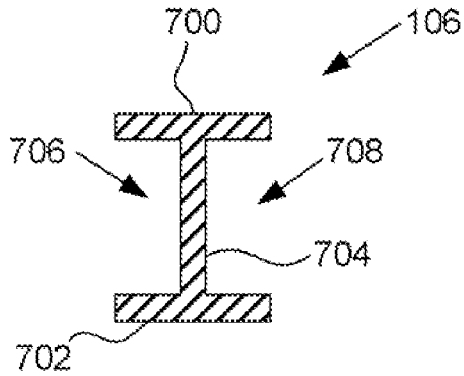
FIG. 7 illustrates a cross section of thermal break channel in accordance with an embodiment of the invention.

Thermal break channel 106 can have any shape as long as it includes an element that serves as a complete or substantially complete physical barrier between portions 102, 104. For example, FIG. 7 illustrates an H-shaped thermal break channel 106. In this embodiment, thermal break channel 106 can be seen as including top surface 700, bottom surface 702, and partition 704 located between top surface 700 to bottom surface 702. The H-shaped configuration illustrated in FIG. 7 allows the thermal break channel 106 to form two slots 706, 708 that can be adapted to butt join the side walls 108 of portions 102, 104 (as shown in FIG. 1). In an embodiment, thermal break channel 106 can be press fit or force fit to the side walls 108 of portions 102, 104. In another embodiment, thermal break channel 106 can be bonded or adhesively fixed to portions 102, 104. Appropriate adhesives and/or sealants that can be used include cold seal acrylic sealants, epoxy sealants, temperature cured sealants and ultraviolet cured sealants. It is also to be understood that thermal break channel 106 can have any other shape (e.g., T-shaped, L-shaped, straight line, etc.) as would be envisioned by one having ordinary skill in the art.

Figure 8:
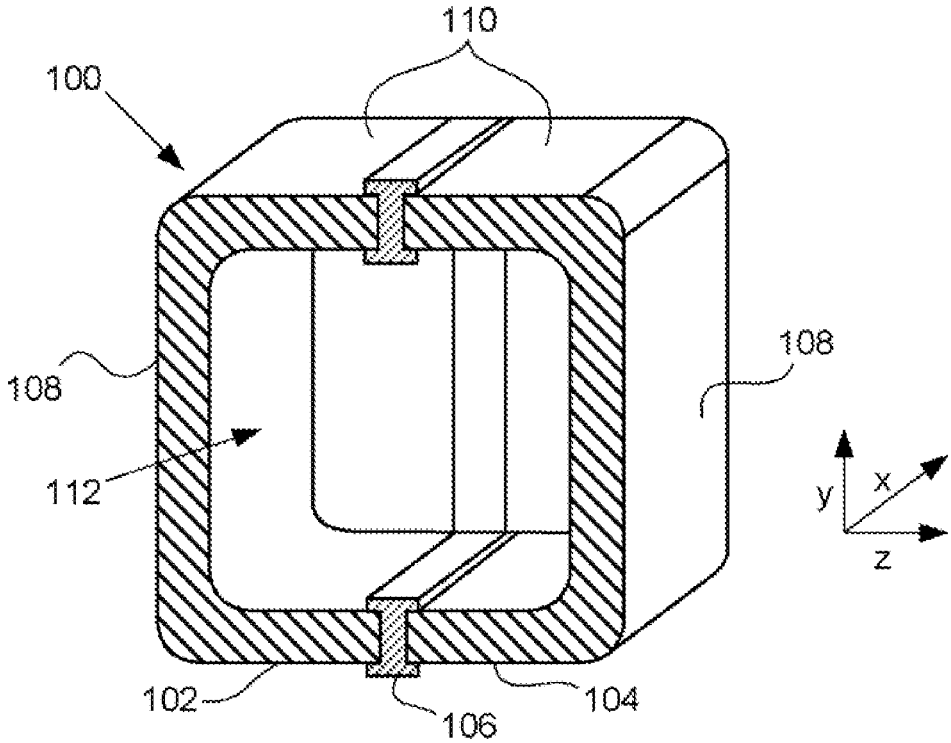
FIG. 8 illustrates a cross section of a glass block assembly in accordance with an embodiment of the invention.
Figure 9:
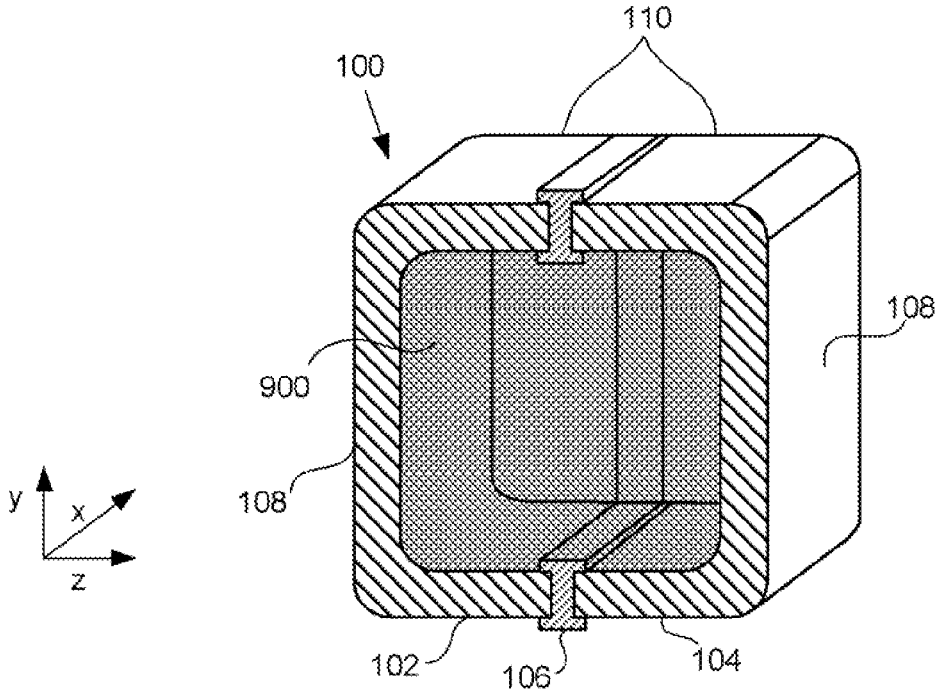
FIG. 9 illustrates a cross section of a glass block assembly that has been filled with fire-resistant gel in accordance with an embodiment of the invention.

Referring now to FIG. 8, FIG. 8 illustrates a perspective cross-sectional view of glass block assembly 100 for the embodiment previously illustrated in FIG. 1. As shown in FIG. 8, glass block assembly 100 includes inner cavity 112, inner cavity 112 being defined by the inner surfaces of the outer panels 108 and side walls 110 of portions 102, 104, as well as the inner surface of thermal break channel 106. In the preferred embodiment, cavity 112 is completely filled with fire-resistant gel 900 (as shown in FIG. 9) to increase the fire-resistive qualities of glass block assembly 100. It is to be understood, however that glass cavity 112 can be filled with any other material that improves the fire-resistive qualities of glass block assembly 100.

In general, gels suitable for use in this invention can include a polymer, a fire-retardant chemical, an polymerization initiator, a polymerization accelerator, and/or a chelator. Generally, any polymer material that is compatible with the supporting material and can associate with the fire-retardant chemical can be used. By way of example, a variety of silicas, acrylamides, plastics, aquagels and related materials are suitable. In certain examples, acrylamide polymers are desirable because they can be prepared easily from readily available materials.

Acrylamide (2-propeneamide; acrylic acid amide; $C_3H_5NO$) can be used to form polyacrylamide gels. Acrylamide can be used as a cross-linking agent for styrene based polyester resins, and can copolymerize with vinylidene chloride to form polyacrylates. Similarly, N-methylolacrylamide ($C_4H_7NO_2$), N—N-methylenebisacrylamide and similar materials can be used to make acrylamide polymers. Formaldehyde ($CH_2O$) and urea ($CH_4N_2O$) can be used to make so-called "urea" gels. Urea gels can also be made with melamine and acetaldehyde. Formaldehyde can also be used with melamine and/or phenols to make gels suitable for use in aspects of this invention. Propylene oxide ($C_3H_6O$) can be used with polyethers, such as poly(ethylene propylene)glycol to make polyether polyol polymers.

Various epoxy resins, polyesters, polyurethanes and polyvinylbutyrates, poloxamers (synthetic block copolymers of ethylene oxide and propylene oxide), polyethylene glycol (polymers of ethylene oxide and water; PEG), polyethylene glycol monomethyl ether (formed from ethylene oxide and methanol) and polysorbates (formed from fatty acid esters of sorbitol copolymerized with ethylene oxide), and carbomers (polymers of acrylic acid cross-linked with allyl ethers) can be used as well.

In certain embodiments, silicates may be advantageously used. Silicates comprise silicon dioxide ($SiO_2$) either in amorphous form or cross-linked to form crystalline structures. Silicates can be made from organic siloxanes or silanes. For example, tetraethylorthosilane (TEOS) is a molecule having the chemical formula: $Si(O—C_2H_5)_4$. When treated under acidic or alkaline conditions, the TEOS molecule can decompose into reactive intermediates including $Si(O^-)_2$. This intermediate can react with others to form polymers of $SiO_2$. For such silicates, the type of precursor molecule is not crucial. Upon hydrolysis, TEOS produces ethyl alcohol. Chemically related alkylsilicates include tetramethylorthosilane (MEOS), and tetrapropylorthosilane (PEOS). It can be readily appreciated that other alkylsiloxanes can be precursors for silicates. It can be appreciated that numerous other types of polymers can be used to make fire-retardant gels of this invention.

Similarly, numerous fire-retardant chemicals can be used. Several classes of fire-retardants that are suitable include reactive organic phosphorous monomers, diols and polyols, oligomeric phosphate-phosphonates, tetrakis(hydroxymethyl)phosphonium salts, oligomeric vinylphosphonates, phosphites, and a variety of other phosphorous-containing polymers. Additionally, mesylated and tosylated celluloses may be used. Three general classes of fire retardants include antimony and other inorganic flame retardants, halogenated flame retardants, and phosphorous-containing flame retardants.

Thus, a variety of soluble retardants can be used, and include salts containing bromine, chlorine, antimony, tin, molybdenum, phosphorous, aluminum and/or magnesium. Specifically, sodium antimonite, boric acid, sodium borate, stannous fluoride, stannous chloride, magnesium chloride, sodium chloride, ammonium phosphates, and melamine phosphates can be used.

Moreover, numerous reactive flame retardants may be used. By "reactive," it is meant that the fire-retardant chemical can interact with the polymer material, the interaction characterized by increased affinity of the fire-retardant chemical with the polymer material. Increased affinity can be reflected in a tendency for the fire-retardant chemical to remain associated with the polymer. This interaction is in contrast with a simple mixture, in which the fire-retardant chemical and the polymer do not have any affinity for each other. The association of the fire-retardant chemical and the polymer can provide substantially increased fire resistance of the polymer. Examples of such interactions include the formation of covalent bonds, ionic bonds, Van Der Waals interactions and physical trapping of the chemical within the matrix of the polymer. However, any type of interaction that promotes the formation of a stable combination of fire-retardant chemical and the polymer matrix can provide improved fire-resistance. Reactive fire-retardant chemicals include, by way of example only, organophosphorous monomers, phosphorous-containing diols and polyols, phosphonomethylated ethers, amide-based systems with cyanamine, halogenated alkyl phosphates and phosphonates, and dialkyl phosphites and related materials.

Further descriptions of these fire-resistant materials are included in the Kirk Othmer Chemical Encyclopedia, volume 10. By way of example only, fire-retardant chemicals that can be used in conjunction with this invention include bromine and chlorine for a total of about 60%, organic halogen compounds, phosphorous containing polyol, boron-phosphate, modified organic halogens, di-linoleic acid/tri-linoleic acid/ethylene diamine copolymers, polyphosphate-nitrogen liquid, inorganic salts, acrylic polymer compounds, dibutyl butylphosphonate, antimony oxide, antimony peroxide, sodium borate, barium metaborate, alumina trihydrate, magnesium hydroxide, decabromodiphenyl oxides, vinyl bromide, dimethylphosphonate, and/or dibromoneopentyl glycol, PYROVATEX™ (dialkyl phosphorus carboxylamide TMM; CIBA Specialty Chemicals), PYROVATEX CP NEW™ (dialkyl phosphorus carboxyl amide), FYROL 99™ (oligomeric 2-chloroethylphosphate; Akzo Nobel Chemicals, Inc.), FYROL DMPP™ (dimethyl methylphosphonate; Akzo Nobel Chemicals, Inc.), BARFIRE PCR™ (Apollo Chemical Corporation), BARFIRE RE™ ("organic phosphate Y;" Apollo Chemical Corporation), EAGLECHLOR 10™ ("chlorinated parrafin W;" Eagle Systems Corporation), EAGLEBAN F/R P-85NE ("Organic Phosphate X;" Eagle Systems Corporation) and FLAMORT XT™ ("NT Aqua Fire Retardant;" Flamort Company Inc.); "decabromodiphenyl oxide-polyacrylate." Mineral hydrates, such as alumina tritrihydrate and magnesium sulfate heptahydrate may be used in thermoset resins. These materials can be used singly or in combination without departing from the scope of this invention.

In fact, it has been observed that flame retardants which belong to more than one class of flame retardant can be more effective than those retardants belonging to only one class. By way of example only, panels prepared with magnesium chloride hexahydrate ($MgCl_2$)*6 ($H_2O$) performed better in burn tests than samples prepared with the same amount of sodium chloride (NaCl). This was attributed the increased efficacy of the $MgCl_2$ solution to the fact that the material is both a metal halide (as is NaCl) and is a mineral hydrate, unlike NaCl, which is not hydrated.

In certain specific embodiments, the gel composition can comprise about 25% base monomer, which comprises about 44% distilled water, about 44% acrylamide, 0.13% methylene bisacrylamide, and about 12% formaldehyde. To the base monomer solution, about 12% magnesium chloride, about 51% distilled water, about 10% of a fire retardant, about 2% sodium persulfate and less than about 1% sodium tungstate can be used. In other embodiments, ammonium persulfate can be used. Other types of gels can be used satisfactorily if they are compatible with the fire-retardant chemical.

In certain embodiments, fire-retardant polymer materials can, when heated, produce a char having a dark surface on the side of the gel facing the source of heat (the inside surface of the gel) and a light surface on the outside surface of the gel facing the exterior of the heated space. When a fire-retardant chemical is polymerized along with the polymer matrix, the char can remain attached to the surface of the polymer on the side exposed to heat. The presence of such an attached char improves the fire-resistance properties of the polymer. In contrast, for materials in which the fire-retardant chemical is not polymerized with the matrix, the ashes tend to fall off, thereby exposing other portions of the polymer, thereby decreasing the fire-resistance of the polymer. Moreover, polymers of this invention can be intumescent, that is, when heated, bubbles can form, thereby increasing the thickness of the polymer, thereby increasing fire-resistance.

In certain embodiments, fire-resistant polymers of this invention include materials that, above 10° C. and below 90° C., are transparent and substantially bubble-free. However, when heated, such as upon exposure to fire, certain fire-resistant polymers of this invention do not degrade rapidly, but rather, can form a char layer of charred polymer material, may expand (i.e., is "intumscent"), or both.

Referring back to FIG. 1, in an embodiment, portions 102, 104 of glass block assembly 100 have the same heights (shown along the y-axis), widths (shown along the x-axis) and thicknesses (shown along the z-axis) as each other, thereby constituting two equivalent halves of glass block assembly 100. Alternatively, portions 102, 104 can have equivalent heights and widths with different thicknesses, thereby constituting two unequal portions of glass block assembly 100. It is to be understood that glass block assembly 100 can have any desired dimension as would be envisioned by one having ordinary skill in the art.

In a specific embodiment of the invention, glass block assembly 100 was formed using two glass block portions 102, 104, each portion 102, 104 having an outer panel 108 and side walls 110 extending away from both of the outer panels 108. The glass block assembly 100 of this embodiment further included cavity 112. A conceptual version of this embodiment is illustrated in FIGS. 1 and 9. In this embodiment, the glass block portions 102, 104 were connected together using a clear acrylic H-shaped thermal break channel 106. Each of the portions 102, 104 had an approximate height of 8", an approximate width of 8", and an approximate thickness of 2". Accordingly, the approximate thickness of the entire glass block assembly 100 was at least 4". Additionally, the outer panel 108 of each of the portions 102, 104 had an approximate thickness of ¾" while the side walls 110 also had an approximate thickness of ¾". The cavity 112 of this embodiment of glass block assembly 100 was filled with an intumescent fire-resistant gel, specifically SUPERLITE™ II Proprietary Fire-Resistant Gel, which is manufactured and distributed by SAFTIFIRST™ Fire Rated Glazing Solutions, a division of O'Keeffe's Inc. This embodiment of glass block assembly 100 was optically clear, and when subjected to a Fire Endurance Test, was found to comply with the requirements for a 2-hour fire rated wall.

In use, glass block assembly 100 can be installed in the normal fashion in accordance with standard glass masonry details incorporating supporting structural and weatherproofing components in order to in-fill an opening within a building.

Method of Making Glass Block Assembly

Figure 10:
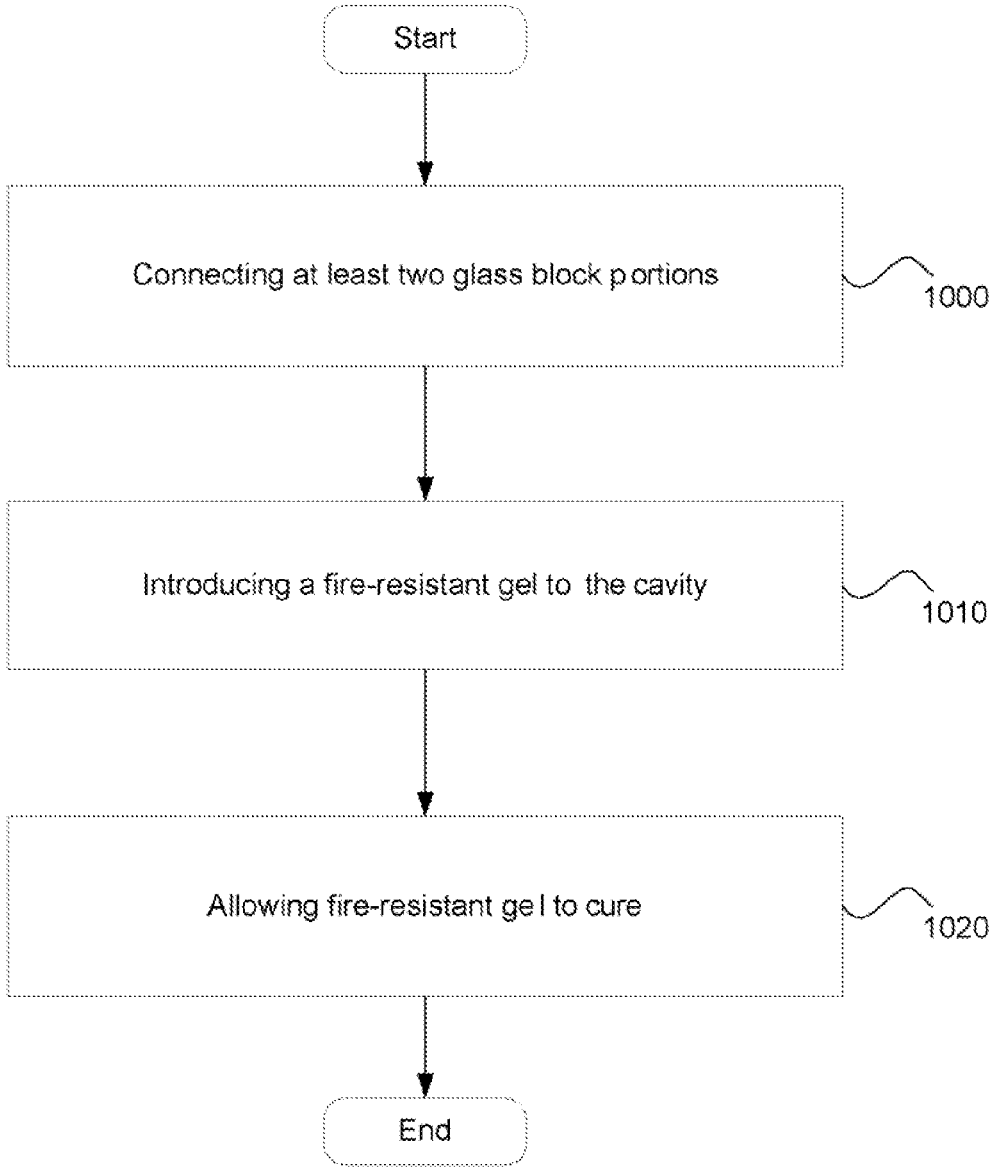
FIG. 10 illustrates a flowchart diagram with functional blocks representing the steps of a method for manufacturing a glass block assembly according to an embodiment of the invention.

FIG. 10 illustrates a flowchart diagram with functional blocks representing the steps of a method for making glass block assembly 100 according to an embodiment of the invention.

Beginning at step 1000, at least two glass block portions are connected together. The glass block portions that make up glass block assembly can be obtained as standard pre-made glass block portions from commercial sources. In other instances, the portions can be obtained by cutting a hollow glass block directly. The glass block is preferably cut into two portions, but can be cut into three or more portions if desired.

Figure 11:
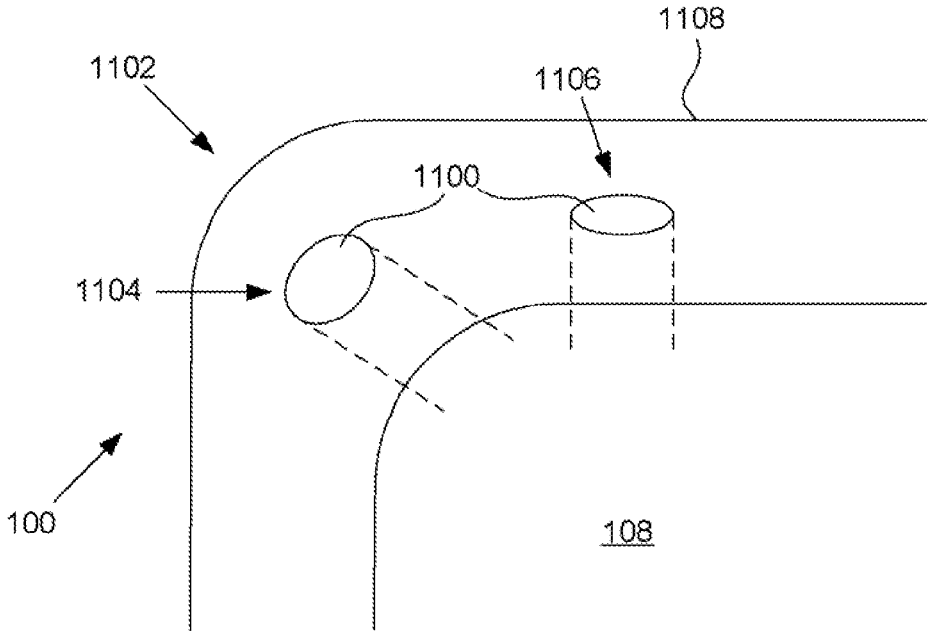
FIG. 11 illustrates a partial view of a glass block assembly showing holes providing access to a cavity of the glass block assembly according to an embodiment of the invention.

When cutting a glass block directly, a hole extending from the outer surface of the glass block to the inner cavity of the glass block can be formed prior to cutting. The hole can be used when filling the glass block with a fire-resistant gel. Forming the hole in the glass block at the outset equalizes the internal and external pressures to allow for the block to be cut without breakage from the vacuum it possesses from the manufacturing process. The hole can be formed using any method known by one having ordinary skill in the art. For example, the hole may be drilled into the glass block using a diamond drill and coolant. As shown in FIG. 11, the hole 1100 is preferably formed at a corner 1102 (position 1104) or proximal to a corner 1102 (position 1106) of glass block assembly 100 in between the two outer panels 108 to minimize the aesthetic impact of the hole 1100 and to allow complete air displacement filling. The hole can range in size depending on the size of the block. Accordingly, a smaller fill hole may be required and/desired for a smaller block.

After forming the hole, the hollow glass block can be split into two or more portions. Any method of splitting the glass block can be used that would be envisioned by one having ordinary skill in the art. For example, the splitting of the glass block can be accomplished by water jet or diamond saw cutting. After splitting the glass block, the two or more portions are inspected for integrity, washed and then dried. The two or more portions can be washed with deionized water and dried in clean room conditions.

The two or more portions can be connected or bonded together using a thermal break channel (the characteristics of the thermal break channel having been described in above). In an embodiment, the thermal break channel can also include a hole that corresponds to the hole formed within the block as described above. As the portions are connected, a first conduit can be inserted into the hole. The first conduit can be, for example, a vinyl fill hose that extends away from the glass block assembly to facilitate the filling process.

In certain instances, a silane process can be performed after the two or more portions have been connected or bonded together. The silane process can include, for example, a wash with a 2% solution in acetone. During this process, liquid can be poured into the cavity of the connected glass block portions through the first conduit. The connected glass block portions can then be turned until all internal surfaces are coated. The remaining solution is then poured out and the solvent is left to evaporate. The solvent can be left to evaporate for a minimum of 10 minutes and a maximum of 10 days before moving on to step 640.

At step 1010, a fire-resistant gel (the characteristics of the fire-resistant gel having been described in detail above) can be introduced to the cavity of glass block assembly. The fire-resistant gel can be introduced to the cavity by clamping the connected glass block portions into a rack with the fill hole facing up to facilitate the filling process. At that point, a second conduit attached to a batch tank containing fire-resistant gel can be inserted into the first conduit to fill the glass block assembly with fire-resistant gel. The second conduit can be, for example, a thin pipe made of acrylic. The unattached end of the second conduit can be inserted into the block until it reaches the block's lowest corner. Once the second conduit is placed at the desired location, the glass block assembly can be filled with the fire-resistant gel. The fire-resistant gel can be pumped, injected, or gravity fed into the glass block. When the fluid level flows up and out of the block into the first conduit, the second conduit is removed and the first conduit is capped off.

At step 1020, the fire-resistant gel is allowed to cure for at least 24 hours. Once the fire-resistant gel has been allowed to cure, the first conduit is detached from the block. The first conduit should be detached from the block in a manner that conceals the first conduit. For example, the first conduit can be cut flush with the block so that it does not extend beyond the thermal break channel. Afterwards, a plug can be inserted into the hole within the glass block assembly where the fire-resistant gel was poured into. The plug can be made of any appropriate material, for example, clear acrylic. Once the plug has been placed within the hole, a secondary seal can be applied over the hole and around the plug on the block's surface. Once the sealant has been allowed to cure, the unit can be cleaned and inspected for use.

The foregoing description of preferred embodiments of the present invention has been provided for the purposes of illustration and description. It is not intended to be exhaustive or to limit the invention to the precise forms disclosed. Many embodiments were chosen and described in order to best explain the principles of the invention and its practical application, thereby enabling others skilled in the art to understand the invention for various embodiments and with various modifications that are suited to the particular use contemplated. It is intended that the scope of the invention be defined by the claims and their equivalents.

The invention claimed is:

1. A fire-resistant glass block comprising:

a first glass portion and a second glass portion, wherein the first and second glass portions each include an outer panel, wherein at least the first glass portion includes side walls extending from the outer panel;

a thermal break channel arranged between and connecting the second glass portion and the sidewalls of the first glass portion to define an inner cavity, an outer extent of the inner cavity being defined by the outer panel of the first glass portion, the outer panel of the second portion, the side walls of the first portion, and the thermal break channel;

wherein the thermal break channel comprises a fire-resistant material having a thermal conductivity value below that of the first glass portion and the second glass portion; and a fire-resistant gel, wherein said fire resistant gel fills at least a portion of said inner cavity.

2. The glass block of claim 1 wherein both the first glass portion and the second glass portion include sidewalls extending away from corresponding outer panels and the thermal break channel includes slots separated by a partition, said slots receiving the side walls of the first and second glass portions, respectively, thereby joining the first glass portion and the second glass portion, wherein the partition provides a thermal barrier between the joined side walls.

3. The glass block of claim 1 wherein the thermal break channel is made of clear acrylic.

4. The glass block of claim 1 wherein the fire-resistant gel comprises a material that crystallizes into heat absorbing char when exposed to fire.

5. The glass block of claim 1 further comprising a secondary seal around the perimeter of the thermal break channel.

6. The glass block of claim 5 wherein the secondary seal comprises one of silicone and sulfide rubber.

7. The glass block of claim 1 wherein the glass block has a fire rating of up to 120 minutes.

8. The glass block of claim 1 wherein the glass block is translucent.

9. The glass block of claim 1 wherein the fire-resistant gel is intumescent.

10. The glass block of claim 1 wherein the block comprises a fill hole proximal to a corner of the block.

11. The glass block of claim 1 wherein the thickness of the block is at least four inches.

12. A method of making a fire-resistant glass block assembly comprising the steps of:

connecting at least two glass block portions using a thermal break channel arranged between the at least two glass block portions, wherein one or more of the at least two glass block portions include sidewalls extending from an outer panel;

wherein the thermal break channel is made of a fire-resistant material having a thermal conductivity value below that of the first glass portion and the second glass portion;

wherein an inner cavity is defined by the at least two glass block portions and the thermal break channel;

wherein an outer extent of the inner cavity is defined by the at least two block portions and the thermal break channel;

introducing a fire-resistant gel to the cavity; and allowing the fire-resistant gel to cure.

13. The method of claim 12 further comprising:

receiving a hollow glass block; and segmenting the hollow glass block into at least two glass block portions.

14. The method of claim 12 further comprising:

forming a hole in the connected glass block portions so that the cavity is accessible, wherein the hole is formed proximal to a corner of the connected glass block portions.

15. The method of claim 14 wherein the hole is formed proximal to a corner of the connected glass block portions.

16. The method of claim 12 further comprising the step of performing a silane process after the connecting step.

17. The method of claim 12 wherein the thermal break channel comprises a material having a thermal conductivity value below that of the at least two glass portions.

18. The method of claim 12 wherein the thermal break channel includes slots separated by a partition, said slots joining the side walls of the at least two glass portions as the partition provides a physical barrier between the joined side walls.

19. A method of making a fire-resistant glass block assembly comprising the steps of:

connecting at least two glass block portions using a thermal break channel arranged between the at least two portions, wherein the connected glass portions define an inner cavity, wherein one or more of the at least two glass block portions include sidewalls extending from an outer panel;

introducing a fire-resistant gel to the cavity;

allowing the fire-resistant gel to cure;

forming a hole in the connected glass block portions so that the cavity is accessible, wherein the hole is formed proximal to a corner of the connected glass block portions;

positioning a conduit within the hole, wherein the fire-resistant gel is introduced to the cavity by way of the conduit; and detaching the conduit so that a portion of the conduit remains within the glass block and does not extend beyond the thermal break channel.

20. A block for use in construction comprising:

a first portion and a second portion;

a thermal break channel separating the first portion and the second portion, wherein the first portion and the second portion are joined by the thermal break channel to define an inner cavity having an outer extent defined by the first portion, the second portion, and the thermal break channel; and wherein the thermal break channel comprises a fire-resistant material having a thermal conductivity value below that of the first portion and the second portion.

* * * * *